US006318646B1

(12) United States Patent
Mattioli et al.

(10) Patent No.: US 6,318,646 B1
(45) Date of Patent: Nov. 20, 2001

(54) FUEL INJECTOR

(75) Inventors: Massimo Mattioli, Castelmaggiore; Massimo Neretti, San Lazzaro di Savena; Luca Tassinari, Forli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/525,296

(22) Filed: Mar. 14, 2000

(30) Foreign Application Priority Data

Mar. 26, 1999 (IN) ..... BO99A0141

(51) Int. Cl.[7] ..... F02M 51/00
(52) U.S. Cl. ..... 239/585.1; 251/51
(58) Field of Search ..... 239/88–92, 96, 239/533.1, 533.2, 533.3, 533.4, 533.5, 533.7, 533.9, 533.15, 585.1, 583, 584; 251/50, 51, 55; 137/513.7

(56) References Cited

U.S. PATENT DOCUMENTS

| | | | |
|---|---|---|---|
| 4,749,892 | 6/1988 | Mesenich | 310/19 |
| 4,878,650 | 11/1989 | Daly et al. | 251/129.15 |
| 5,127,585 | 7/1992 | Mesenich | 239/585.5 |

FOREIGN PATENT DOCUMENTS 3139948 4/1983 (DE) .

*Primary Examiner*—Lesley D. Morris
(74) *Attorney, Agent, or Firm*—Ladas & Parry

(57) ABSTRACT

A fuel injector comprising a main tubular body provided with at least one through duct that terminates in a spray nozzle adapted to atomise the fuel contained in the through duct, a shutter member moving axially in this through duct from and to a closed position in which the shutter member is disposed in abutment on the spray nozzle closing it off in such a way as to prevent any discharge of fuel, and lastly a hydraulic damper adapted to brake the shutter member during its return to the above-mentioned closed position.

8 Claims, 2 Drawing Sheets

A
23
11
3
22
19
20
20
5
9b
21
21
10
1
6
4
8
2
9a
3
7
18
2a
3a 19
9b
5
12
6
20
20
10
15
14
13
2
9a
4
7
8
3

FUEL INJECTOR

The present invention relates to a fuel injector.

The present invention relates in particular to a fuel injector for direct injection engines, to which the following description will relate without entering into general details.

BACKGROUND OF THE INVENTION

As is known, the fuel injectors for direct injection engines that are commercially available at present comprise a main tubular body provided with a central through duct which terminates at one axial end of the tubular body in a spray nozzle adapted to atomise, in the combustion chamber, the high pressure fuel supplied within the duct, a shutter member mounted to move axially in the central duct to and from a closed position in which it obstructs the spray nozzle so as to prevent any discharge of fuel and a recall spring adapted to maintain this shutter member in the above-mentioned closed position.

Outside the main tubular body, the above-mentioned injectors further comprise a coil of electrically conducting material adapted to generate, when electric current passes through it, a magnetic field able to overcome the resilient force of the spring so that the shutter member can be temporarily moved from the closed position in order to enable fuel to be discharged. The shutter member is obviously made at least partially from ferromagnetic material.

As is known, fuel injectors for direct injection engines raise the problem of preventing the shutter member, in the closed state, after having violently struck the spray nozzle under the thrust of the spring, from rebounding repeatedly before settling permanently in the closed position. These rebounds have a major impact on the average life of the component and are the cause of undesired discharges of fuel following the theoretical moment of closure of the injector.

In order to remedy this problem, the shutter member at present comprises a bushing of ferromagnetic material mounted to move axially within the central duct, a closure pin mounted to move axially on the bushing with its point facing the calibrated hole that defines the spray nozzle and a resilient member interposed between the bushing and the pin so as to absorb the axial mechanical stresses to which the pin is subject when the point of the pin violently strikes the nozzle.

Unfortunately, the fuel injectors for direct injection engines described above have the major drawback that they are structurally complicated and therefore intrinsically not very reliable. Moreover, the injector assembly procedure is particularly time-consuming as a result of which the production costs of fuel injectors for direct injection engines are much greater than the production costs of conventional fuel injectors.

SUMMARY OF THE INVENTION

The object of the present invention is to provide a fuel injector for direct injection engines that is able to remedy the above-mentioned drawbacks.

The present invention therefore relates to a fuel injector comprising a main tubular body provided with at least one through duct that terminates in a spray nozzle adapted to atomise the fuel contained in the through duct, and a shutter member moving in the through duct from and to a closed position in which this shutter member is disposed in abutment against the spray nozzle, closing it in such a way as to prevent any fuel discharge, the fuel injector being characterised in that it comprises damper means of fluid-dynamic type adapted to brake the shutter member during its return to the closed position.

BRIEF DESCRIPTION OF THE DRAWINGS

The present invention will now be described with reference to the accompanying drawings, which show a non-limiting example thereof, and in which.

DETAILED DESCRIPTION OF THE INVENTION

Figure 1:
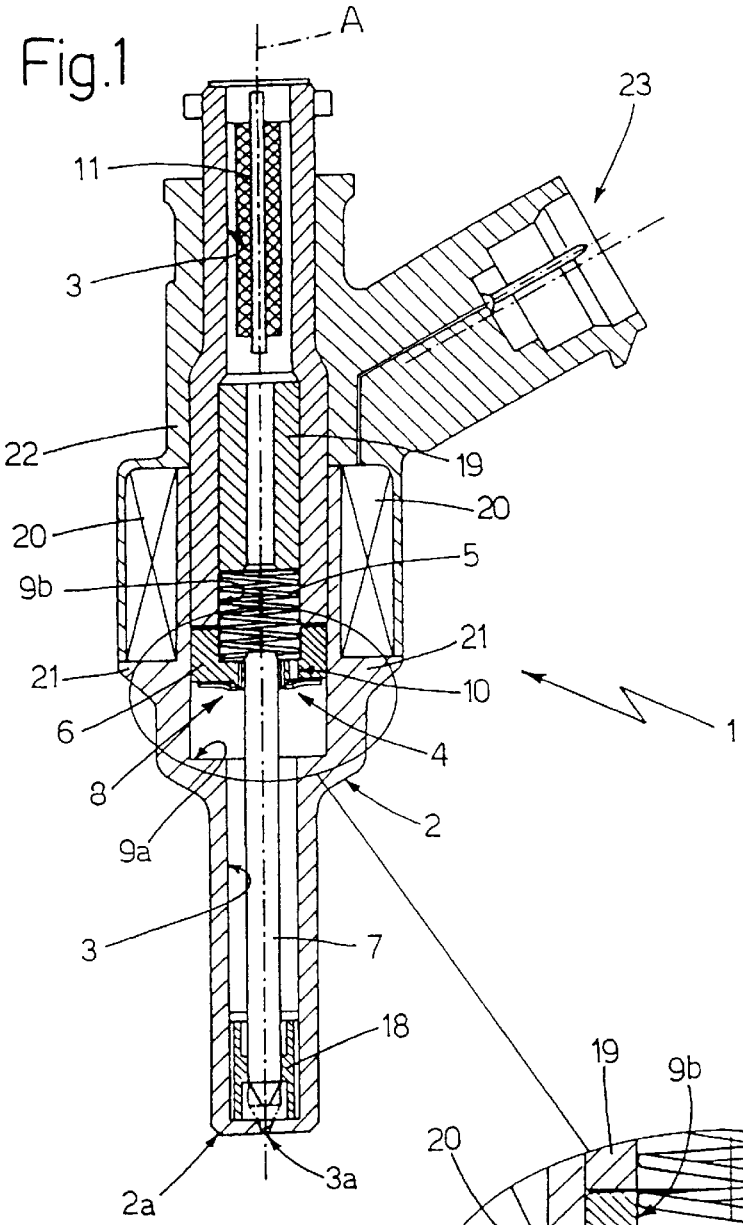
FIG. 1 is a sectional view through a fuel injector of the present invention.

In FIG. 1, a fuel injector particularly adapted to be mounted on direct injection engines of known type is shown overall by 1.

The injector 1 comprises a main tubular body 2 which is provided with a through duct 3 of variable diameter which extends coaxially to the longitudinal axis A of the tubular body 2 and terminates at one axial end 2*a* of the tubular body 2 in a spray nozzle 3*a* adapted to atomise, in the engine combustion chamber (not shown), the high pressure fuel flowing within this duct 3.

The injector 1 further comprises a shutter member 4 mounted to move axially within an end portion of the duct 3 to and from a closed position, in which this shutter member 4 closes off the spray nozzle 3*a* in such a way as to prevent any discharge of fuel and a recall spring 5 adapted to maintain the shutter member 4 in the above-mentioned closed position.

In the embodiment illustrated, the tubular body 2 is in particular formed by two tubular bodies coupled together mechanically, and the shutter member 4 is formed by a bushing 6 of ferromagnetic material mounted to move axially within the larger diameter section of the duct 3 and by a closure pin extending in a projecting manner from the bushing 6 towards the spray nozzle 3*a* coaxially with respect to the axis A. When the shutter member 4 is in the closed position, the point of the closure pin 7 is disposed in abutment against the calibrated hole that defines the spray nozzle 3*a* so as to close it off and prevent any discharge of fuel.

Figure 2:
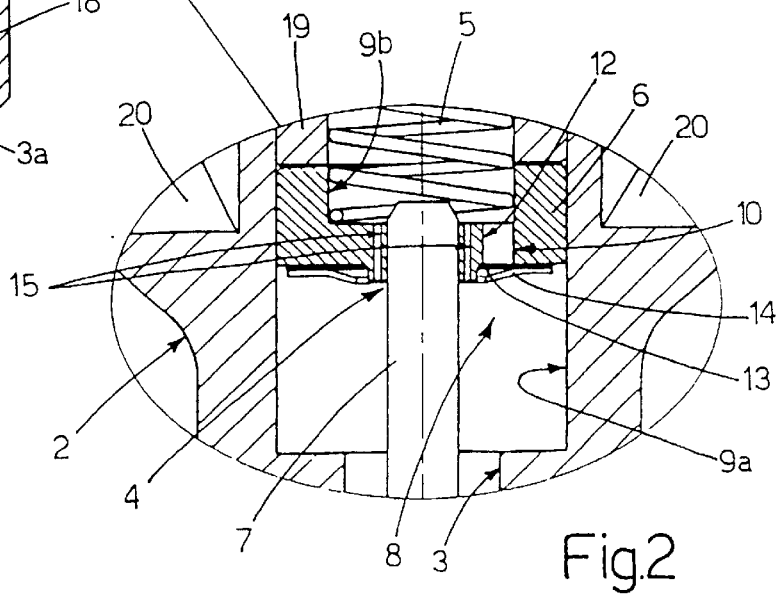
FIG. 2 shows a detail of FIG. 1 on an enlarged scale.

With reference to FIGS. 1 and 2, the injector 1 further comprises a hydraulic damper 8 adapted to brake the shutter member 4 while it is closing in order to reduce the speed of impact of the point of the closure pin 7 on the spray nozzle 3*a* and thereby to eliminate any rebounds of the shutter member 4 on the spray nozzle 3*a*.

In the embodiment illustrated, the hydraulic damper 8 comprises the two variable volume chambers into which the shutter member 4 divides the duct 3 and a one-way valve 10 adapted to allow fuel to pass from one chamber to the other but not vice versa.

The bushing 6 divides the duct 3 into two complementary variable volume chambers, the first of which, shown by 9*a*, is formed by the section of duct between the bushing 6 and the spray nozzle 3*a* and the second of which, shown by 9*b*, is formed by the section of duct between the bushing 6 and the other axial end of the duct 3 in which a fuel filter 11 of known type is normally disposed. The one-way valve 10 allows the fuel to pass from the chamber 9*b* to the chamber 9*a* but not vice versa.

In the embodiment illustrated, the one-way valve 10 is provided directly on the bushing 6 and comprises a duct 12 for the passage of the fuel, extending through the body of the bushing 6 parallel to the axis A, and a flexible plate 13 secured to the bushing 6 within the chamber 9*a* so as to close off the inlet of the duct 12 in the rest position. The flexible plate 13 is preferably, but not necessarily, made from metal, while the one-way valve 10 may also be provided with an abutment member 14 secured to the bushing 6 above the flexible plate 13 so as to limit the deformation of this flexible plate 13.

The flow of fuel from the chamber 9*a* to the chamber 9*b* takes place via the assembly clearances that naturally exist between the bushing 6 and the inner surface of the duct 3 or, in addition, through one or more discharge ducts 15 having a flow cross-section calibrated in such a way as to slow down the flow of fuel.

With reference to FIGS. 1 and 2, in the embodiment illustrated, the discharge ducts 15 of the hydraulic damper 8 are obtained in the body of the bushing 6 parallel to the fuel flow duct 12.

It will be appreciated that the one-way valve 10 may also comprise a plurality of fuel flow ducts 12 distributed angularly about the axis A; in this case, the flexible plate 13 may be formed by an annular metal plate of "daisy" shape.

Preferably, but not necessarily, the shutter member 4 lastly comprises a centering nut 18 fitted in a sliding manner on the stem of the closure pin 7 in order to maintain the point of the closure pin 7 aligned with the spray nozzle 3*a*.

The recall spring 5 is disposed in the duct 3 coaxially to the axis A with a first end abutting on the bushing 6 and a second end abutting on a shoulder obtained within the duct 3. In the embodiment illustrated, this shoulder is formed by the axial end of a spring-thrusting member 19 inserted within the duct 3 on the opposite side of the closure pin 7 with respect to the bushing 6. This spring-thrusting body 19 forms an integral part of the tubular body 2, has a cylindrical tubular shape, and is preferably, but not necessarily, of ferromagnetic material. The position of the spring-thrusting body 19 within the duct 3 can be adjusted during the assembly of the injector 1 in order to adjust the compression of the recall spring 3.

The injector 1 lastly comprises a coil 20 of electrically conducting material fitted on the tubular body 2 with an axial end abutting on an outer annular shoulder 21 provided on the tubular body 2, and an outer protective casing 22 in turn fitted on the coil 20 and on the annular shoulder 21 so as to close the coil 20 on the tubular body 2. When electric current passes through it, the coil 20 is adapted to generate a magnetic field able to overcome the elastic force of the recall spring 19 and axially to move the shutter member 4 in order to displace it from the closed position.

In the embodiment illustrated, an electrical connector 23, through which is possible to supply the electric current to the coil 20, is provided on the outer casing 22.

Figure 4:
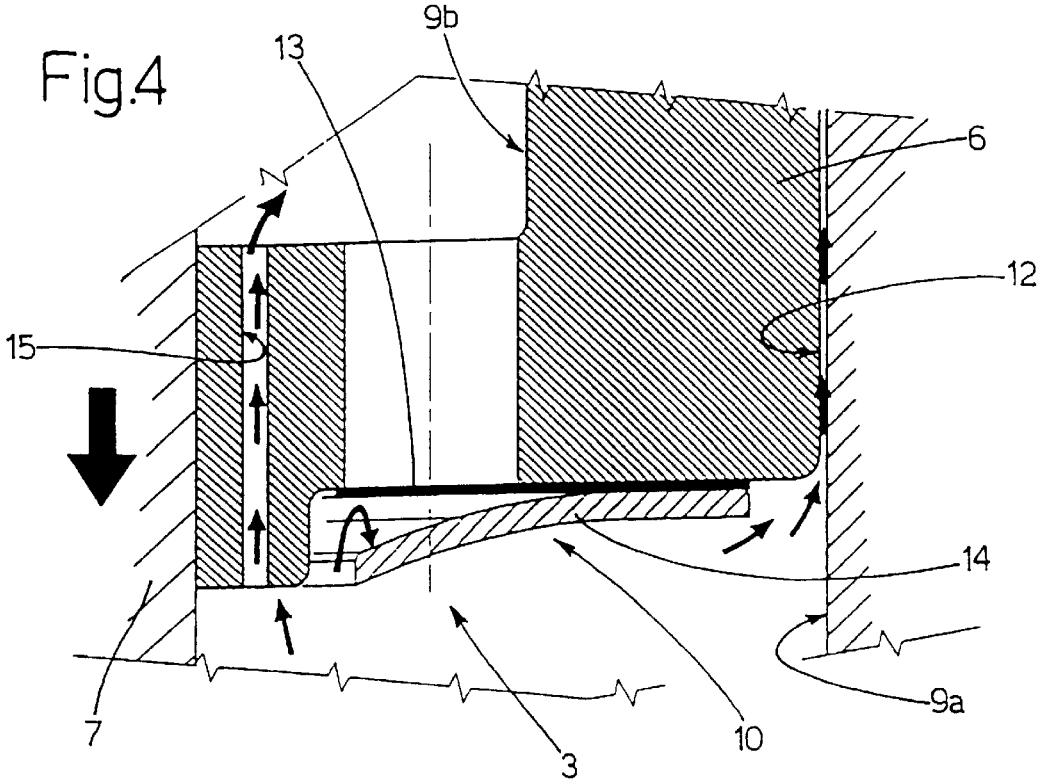
FIGS. 3 and 4 show, in cross-section, a component of the fuel injector shown in FIG. 1, in two different operating configurations.

The operation of the fuel injector 1 will be described with reference to FIGS. 3 and 4, assuming that the shutter member 4 is initially in the closed position, with the fuel filling the chambers 9*a* and 9*b* at rest and at the same pressure in both chambers.

Figure 3:
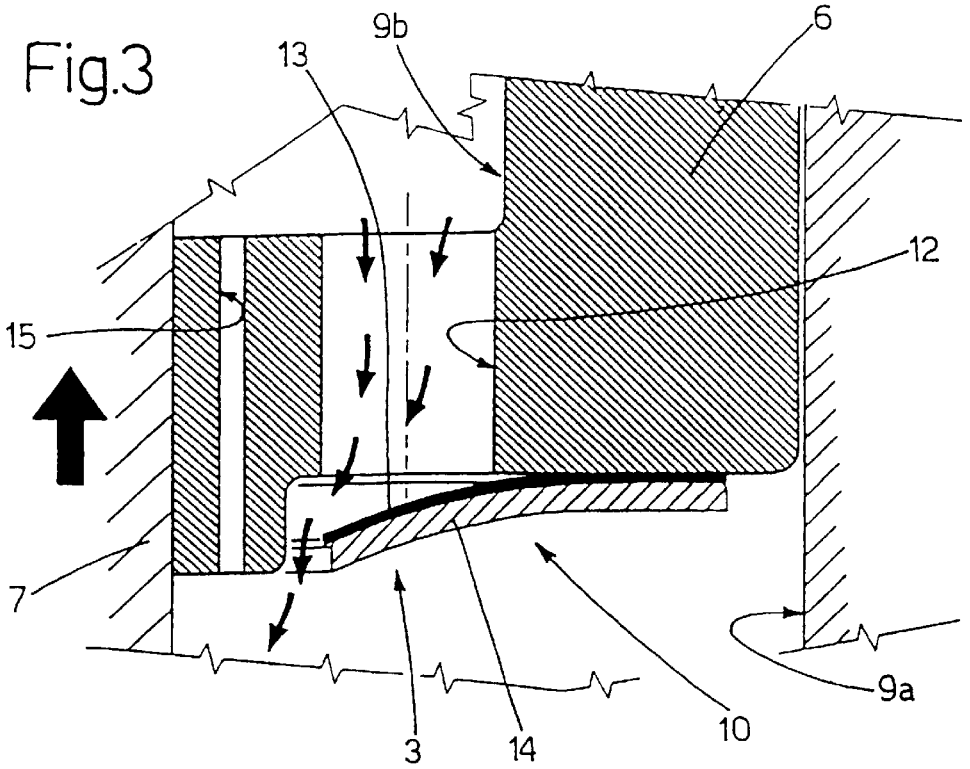

During the opening of the injector 1, the axial displacement of the shutter member 4 causes a pressure difference between the chamber 9*a* and the chamber 9*b* as a result of which the flexible plate 13 is deformed and exposes the inlet of the duct 12 (FIG. 3). The opening of the inlet of the duct 12 allows the fuel to flow from the chamber 9*b* to the chamber 9*a* with a small loss of load.

As the injector 1 gradually opens, the rate of flow of the fuel through the valve 10 gradually increases; this flow maintains the flexible plate 13 in the open position even when the shutter member completes its axial stroke, stopping when the injector is in the completely open position.

During the closure of the injector, from the completely open position, the shutter member 4, under the thrust of the spring 5, gradually acquires speed in order to move into the closed position. The return of the shutter member 4 to the closed position entails a reduction of the volume of the chamber 9*a,* but the flow of fuel able to pass through the spray nozzle 3*a* decreases rapidly as a result of the reduction of the flow cross-section of this spray nozzle 3*a.* The calibrated hole that forms the spray nozzle 3*a* is gradually engaged by the point of the closure pin 7.

As there are no other outlets, the fuel contained in the chamber 9*a* thus tends to pass via the one-way valve 10 as a result of which the flow of fuel through the duct 12 is gradually reduced until it is reversed. At this point, the flexible plate 13 returns to the rest position, closing the inlet of the duct 12, as a result of which the fuel, as it can find no other escape outlet, flows from the chamber 9*a* to the chamber 9*b* via the assembly clearances and/or discharge ducts 15 (FIG. 4).

Given the reduced cross-section of the assembly clearances and/or discharge ducts 15, there is a rapid increase in the pressure of the fuel in the chamber 9*a,* which, countering the action of the spring 5, gradually slows downs the speed of the shutter member 4. The braking action of the shutter member 4 becomes more substantial as the point. of the closure pin 7 moves towards the spray nozzle 3*a* so as substantially to slow down the shutter member 4 only in the final section of the stroke of this shutter member 4.

In this way, the point of the closure pin 7 strikes the spray nozzle 3*a* at a reduced speed thereby preventing any rebounds.

As well as completely eliminating any rebounds of the shutter member 4, the injector 1 substantially reduces the speed of impact of the point of the closure pin 7 on the spray nozzle 3*a,* thereby helping to make the device less noisy. The reduction of the mechanical stresses also increases the average life of the component.

It is be evident that modifications and variations may be made to the injector 1 as described and illustrated without thereby departing from the scope of the present invention.

What is claimed is:

1. A fuel injector (1) comprising a main tubular body (2) provided with at least one through duct (3) which terminates in a spray nozzle (3*a*) adapted to atomize fuel contained in the at least one through duct (3), and a shutter member (4) moving in the at least one through duct (3) from and to a closed position, in which the shutter member (4) closes the spray nozzle (3*a*), to prevent any fuel discharge, the fuel injector (1) being characterized in that it comprises damper means (8) of fluid-dynamic type adapted to brake the shutter member (4) during its return to the closed position.

2. A fuel injector as claimed in claim 1, characterized in that the shutter member comprises a bushing (6) mounted to move axially within the at least one through duct (3), and a closure pin (7) extending from the bushing (6) towards the spray nozzle (3*a*), the closure pin (7) being rigidly connected to the bushing (6), a point of the closure pin (7) being adapted to be disposed in abutment against the spray nozzle (3*a*) when the shutter member (4) is in the closed position so as to prevent any discharge of fuel.

3. A fuel injector as claimed in claim 2, characterized in that the bushing (6) defines, within the at least one through duct (3), first 9(*b*) and second (9*a*) variable volume chambers that are complementary , the second variable volume chamber (9*a*) communicating externally via the spray nozzle (3*a*), the damper means (8) of fluid-dynamic type comprising a one-way valve (10) adapted to enable the fluid to flow solely from the first (9*b*) variable volume chamber to the second (9*a*) variable volume chamber.

4. A fuel injector as claimed in claim 3, characterized in that the one-way valve (10) is provided in a body of the bushing (6).

5. A fuel injector as claimed in claim 4, characterized in that the one-way valve (10) comprises a fuel flow duct (12) extending through the body of the bushing (6) parallel to an axis (A) of the tubular body, and a flexible plate (13) secured to the bushing (6) within the second variable volume chamber (9*a*) so as to close off, in a rest position, an inlet of the fuel flow duct (12).

6. A fuel injector as claimed in claim 5, characterized in that the flexible plate (13) is made from metal.

7. A fuel injector as claimed in claim 5, characterized in that the one-way valve (10) comprises an abutment member (14) secured on the bushing (6) above the flexible plate (13) in order to limit deformation of the flexible plate (13).

8. A fuel injector as claimed in claim 3, characterized in that the damper means (8) of fluid-dynamic type comprises at least one discharge duct (15) connecting the first (9*b*) variable volume chamber, and the second (9*a*) variable volume chamber together, the discharge duct (15) having a cross-section calibrated so as to slow down flow of fuel.

* * * * *